US009824818B2

(12) United States Patent
Earhart et al.

(10) Patent No.: US 9,824,818 B2
(45) Date of Patent: Nov. 21, 2017

(54) METHOD OF MANUFACTURING WOUND TRANSFORMER CORE

(71) Applicant: Keith D Earhart, Waxhaw, NC (US)

(72) Inventors: Keith D Earhart, Waxhaw, NC (US); John S Hurst, Monroe, NC (US)

(73) Assignee: Keith D. Earhart, Waxhaw, NC (US)

( * ) Notice: Subject to any disclaimer, the term of this patent is extended or adjusted under 35 U.S.C. 154(b) by 291 days.

(21) Appl. No.: 14/743,635

(22) Filed: Jun. 18, 2015

(65) Prior Publication Data

US 2016/0020020 A1 Jan. 21, 2016

Related U.S. Application Data

(63) Continuation-in-part of application No. 13/573,986, filed on Oct. 18, 2012, now abandoned.

(60) Provisional application No. 61/627,916, filed on Oct. 19, 2011, provisional application No. 61/634,123, filed on Feb. 22, 2012.

(51) Int. Cl.

| | |
|---|---|
| ***H01F 41/02*** | (2006.01) |
| ***H01F 27/25*** | (2006.01) |
| *H01F 41/06* | (2016.01) |

(52) U.S. Cl.

CPC ..... *H01F 41/0226* (2013.01); *H01F 27/25* (2013.01); *H01F 41/06* (2013.01); *Y10T 29/49071* (2015.01)

(58) Field of Classification Search

CPC ..... H01F 27/24; H01F 27/245; H01F 27/25; H01F 27/26; H01F 41/06; H01F 41/061; H01F 41/0226; Y10T 29/49071

See application file for complete search history.

(56) References Cited

U.S. PATENT DOCUMENTS

| | | | | |
|---|---|---|---|---|
| 2,411,374 A | | 11/1946 | Horstman | |
| 2,548,624 A | * | 4/1951 | Sclater | H01F 41/024 29/609 |
| 2,579,578 A | * | 12/1951 | Horstman | H01F 27/2455 29/609 |
| 3,233,311 A | * | 2/1966 | Giegerich | H01F 27/022 264/272.19 |
| 3,548,355 A | * | 12/1970 | Miller | H01F 27/2847 336/185 |
| 3,611,226 A | * | 10/1971 | Cotton | H01F 27/022 29/602.1 |
| 3,708,875 A | * | 1/1973 | Martincic | H01F 27/2847 29/602.1 |
| 3,774,298 A | * | 11/1973 | Eley | H01F 27/322 264/272.19 |
| 4,557,039 A | | 12/1985 | Manderson | |

(Continued)

*Primary Examiner* — Carl Arbes

(74) *Attorney, Agent, or Firm* — Jurgen Vollrath

(57) ABSTRACT

In a single phase transformer core and transformer, thin-strip metal is wound into multiple rings of different widths and arranged to define a ring-like structure having a stepped, substantially circular cross-section without any cuts or gaps in the magnetic path, or the core is wound from a tapered strip that is configured to define a substantially circular cross-section when wound, while in a three phase transformer core and transformer two inner frames, each made of one or more wound rings are arranged side-by-side and an outer frame of one or more rings is wound around the two inner frames, the core being covered with epoxy prior to winding coils on it.

18 Claims, 7 Drawing Sheets

(56) References Cited

U.S. PATENT DOCUMENTS

| | | | | |
|---|---|---|---|---|
| 4,848,684 | A | 7/1989 | Sasaki et al. | |
| 5,063,654 | A * | 11/1991 | Klappert | H01F 41/024 29/609 |
| 5,134,771 | A * | 8/1992 | Lee | H01F 27/25 29/606 |
| 5,285,565 | A * | 2/1994 | Ballard | H01F 41/0226 29/609 |
| 5,329,270 | A * | 7/1994 | Freeman | H01F 27/25 29/609 |
| 5,387,894 | A | 2/1995 | Allan et al. | |
| 5,528,817 | A * | 6/1996 | Klappert | H01F 41/024 29/564.6 |
| 6,411,188 | B1 * | 6/2002 | Pruess | H01F 1/153 29/602.1 |
| 6,668,444 | B2 * | 12/2003 | Ngo | H01F 27/25 29/602.1 |
| 7,057,489 | B2 * | 6/2006 | Nathasingh | H01F 41/0213 336/234 |
| 7,075,402 | B1 * | 7/2006 | Reyal | C21D 7/02 336/234 |
| 2001/0030594 | A1 | 10/2001 | Abe | |
| 2004/0022294 | A1 | 2/2004 | Yamamori et al. | |
| 2010/0194515 | A1 * | 8/2010 | Hurst | H01F 27/23 336/212 |
| 2011/0248808 | A1 | 10/2011 | Singh et al. | |

* cited by examiner

METHOD OF MANUFACTURING WOUND TRANSFORMER CORE

The present application claims priority from U.S. Provisional Patent Application 61/627,916 filed Oct. 19, 2011 in the name of Keith D. Earhart and John S. Hurst, U.S. Provisional Patent Application 61/634,123 filed Feb. 22, 2012 in the name of Keith D. Earhart, and U.S. patent application Ser. No. 13/573,986 filed Oct. 18, 2012.

FIELD OF THE INVENTION

The present invention relates to wound transformer cores.

BACKGROUND OF THE INVENTION

Transformers cores are typically made of layers of magnetic steel in order to reduce eddy current effects. One approach has been to manufacture stacked cores in which Silicon Steel is cut into lengths and stacked on top of one another to form a stack of laminated steel. Typically stacks are arranged in core configurations e.g., a FIG. 8 configuration in which the stacks are intertwined at their corners. This approach works adequately when dealing with Silicon Steel sheets that are typically of the order of 10 mil thick. However the downside is two-fold. Firstly, the machinery for cutting and stacking the sheets is extremely expensive and due to the repetitive cutting actions and back and forth movements, is prone to frequent failure and requires a high degree of maintenance. Secondly, the flat stack technology becomes very time consuming and costly when using thinner material.

More recently materials such as amorphous metal that is of the order of 1 mil thick and nano-grain steel that is of the order of 2 mil thick have become available. The flat stack technology discussed above therefore does not provide a satisfactory solution to making transformer cores using these materials. Thus, although these materials display lower losses, the flat stack manufacturing process does not lend itself to making cores from the material.

An alternative method of making cores that has also been used involves the winding of core material onto a reel. In the case of smaller wound cores the transformer conductor is usually subsequently wound through the window using a bobbin to form coils on the core, or in some instances the ferromagnetic core material may be wound through the coil. In larger wound core units the ferromagnetic material is cut to varying lengths (laminations) and wound into a generally square shape with gaps in the core that can be opened (unlaced) to allow coils to be landed upon the core at which point the core can be closed (re-laced) to complete the magnetic circuit.

Extant techniques for manufacturing wound cores composed of amorphous metal are, for example, described in U.S. Pat. Nos. 5,285,565; 5,327,806; 5,063,654; 5,528,817; 5,329,270; and 5,155,899, which describe ribbon winding, lamination cutting, lamination stacking, lamination winding, annealing, and coating the edge of the core.

The prior art wound cores, however, typically have a generally rectangular shape with a joint at one end that can be opened (unlaced) to allow the landing of a coil that has been wound separately. Once the coil has been landed the core must be closed (re-laced).

Irregularities in the laminations can prevent the joint overlaps from matching perfectly.

Also, the winding of the amorphous core into a generally rectangular shape can detrimentally impact the performance since stresses are introduced when forming the corners of the core.

Additional problems are encountered specifically when dealing with amorphous metal as the magnetic core material. Amorphous laminations are thin, ranging from 0.001 to 0.0011 inches in thickness. Amorphous metal also lacks the structural integrity of silicon steel, displaying instead the floppiness of wet tissue paper even though it has quite high tensile strength. By comparison, silicon steel has much greater structural integrity than amorphous metal so that the silicon steel core is capable of retaining its shape once wound.

Thin materials such as amorphous metal and nano-grain steel also require 5 to 10 times more layers to build up the core, requiring a longer winding process and more difficulties with unlacing and re-lacing of the core in order to land the coils on the core.

Amorphous metal also becomes quite brittle once annealed, making this core manufacturing process quite complex when compared to the core manufactured from silicon steel. The brittleness of annealed amorphous metal leads to inevitable breakage and flaking when unlacing and re-lacing an amorphous core.

It will therefore be appreciated that a construction method for amorphous and nano-grain cores that eliminates lamination damage and breakage, reduces stress within the core, reduces the time to assemble the transformer, and the time required to wind the core would be very valuable. In particular, it would allow the realization of the potentially low losses offered by amorphous metal and nano-grain steel.

SUMMARY OF THE INVENTION

The present invention relates to wound cores in which the core cross-section is arranged to approximate a circle. This has the advantage that the coils can be wound onto the legs of the core using a winding tube, while maintaining a good fill factor (ratio of core cross-sectional area passing through a coil relative to the total cross-sectional area offered by the coil for accommodating the coil), instead of having to open up the core in order to land the coils. This avoids breakages and gaps in the core material and thus reduces losses. It also eliminates the problems of flaking and damage to the core associated with unlacing and re-lacing.

According to the invention, there is provided a core and a method of making a core from magnetic steel having a thickness of less than 2.5 mil, e.g., amorphous metal or nano-grain steel as manufactured by AK steel, collectively referred to herein in as thin-strip metal.

Further, according to the invention, there is provided, a method of making a thin-strip metal transformer core for a transformer, comprising winding one or more rings, each ring formed by winding multiple turns of continuous thin-strip metal, wherein the thin-strip metal is controlled so that the turns lie one on top of the other with the center line of the strip for each turn aligned in a plane; configuring the one or more rings to define two or more straight core legs having a substantially circular cross-section, and freezing the core by applying an epoxy or other shell to the outer surfaces of the core before applying any transformer coil windings.

Each ring may be wound from parallel sided thin-strip-metal, in which the rings of different strip widths are wound on top of each other to define the substantially circular cross section for the core legs. The core may be configured to have two straight core legs, which are connected at each end by a yoke.

The method may further comprising winding a first set of two or more rings of different strip widths on top of each other to define a first frame; winding a second set of two or more rings of different strip widths on top of each other to define a second frame; arranging the first and second frames next to each other to define a first core leg of a transformer core between them, and winding a third set of two or more rings of different strip widths on top of first and second frames, to define a second and a third core leg located on either side of the first core leg.

The freezing may comprise applying an epoxy to the core at one or more stages as the rings are being wound, or continuously as the rings are being wound, or once all of the rings have been wound.

At least some of the rings may be wound from strips of thin-strip metal, the longitudinal sides of which are non-parallel for at least part of the length of the strip. The strip for each ring may include a first end defining a starting end and a second end defining a terminating end, wherein one or more of the rings has a non-parallel sided, tapered portion at the starting end or the terminating end or at both the starting and terminating ends.

The method may further comprise winding a first ring from a thin-strip metal having a non-parallel sided, tapered portion at the starting end, to define a first frame; winding a second ring from a thin-strip metal having a non-parallel sided, tapered portion at the starting end, to define a second frame; arranging the first and second frames next to each other to define a first core leg of a transformer core between them, and winding a third ring from a thin-strip metal having a non-parallel sided, tapered portion at the terminating end, on top of first and second frames, to define a second and a third core leg located on either side of the first core leg. The non-parallel tapered portions may be non-linear tapered portions.

Still further, according to the invention, there is provided a method of making a transformer, comprising winding a transformer core, which includes winding one or more rings, each ring formed by winding multiple turns of continuous thin-strip metal, wherein the thin-strip metal is controlled so that the turns of the strip lie one on top of the other with the center line of the strip for each turn aligned in a plane, and configuring the one or more rings to define two or more straight core legs having a substantially circular cross-section, the method further comprising freezing the core by applying an epoxy or other shell to the outer surfaces of the core, and applying transformer coil windings to at least some of the legs after the freezing step.

The method may include winding the core in a cruciform configuration as discussed in greater detail below.

The present invention includes single-phase gapless, wound cruciform transformer cores formed from wound, thin-strip metal, and to processes for producing these cores and for producing transformers using these cores. The thin-strip metal may be slit from master rolls of amorphous alloy or other thin-strip metal. The cores may comprise multiple wound rings of amorphous strips or other thin-strip metal without any cuts or gaps in the rings.

For purposes of this application cuts or gaps in a ring refer to discontinuities in a ring that are provided in order to land or place coils on a core. Inadvertent breakages in the strips, and the beginnings and ends of the continuous strips used in the winding of a core ring without the need for stacking sections of the strip are not considered cuts or gaps in the ring since they are not expressly cut in order to land a coil and do not provide gaps that extend all the way through the ring to allow the ring to be opened up for purposes of landing a coil.

According to the invention there is provided a single phase core in which the core comprises a wound ring-like structure that includes at least two rings wound on top of each other from different thin-strip metal strip widths. Each ring may be wound using multiple payouts of the same strip width to speed up the build. The rings may be formed in a race-track configuration with two substantially straight, parallel legs that are connected at each end by a yoke. The race-track configuration may be achieved by winding the rings onto a suitably shaped former, e.g. two half-circular sections spaced apart to define an oblong form or wound on a circular former and subsequently shaped into racetrack shape. For purposes of this application the term racetrack includes a configuration in which the legs of the core are substantially straight and parallel and the yokes are either curved or are flat with rounded corners joining the yokes to the legs, i.e., a rectangular form with rounded corners. The core may be wound in a cruciform cross-section with at least one middle ring of a first strip width and an inner ring and an outer ring of a second strip width that is narrower than the first strip width. More than three rings with strips of different widths may be wound on top of one another in a stair step arrangement Thus, there is provided a single phase, wound transformer core, comprising a ring-like structure that includes multiple rings of different widths arranged on top of each other to define a stepped cross-sectional ring-like structure. For purposes of this application, the terms "inner ring", "middle rings" and "outer ring" will refer to the order in which the rings are wound on top of one another, first the inner ring, followed by one or more middle rings of different strip widths, followed by an outer ring. The number of layers per ring may be different for different rings. Thus the rings may have a different height or build. The difference in width between adjacent rings may be constant or may vary. Thus, in order to define a substantially stepped cross-sectional ring-like structure, the inner and outer ring may have a smaller height or build than the one or more middle rings but the incremental change in strip width from one ring to the next may remain constant. Instead, the number of layers per ring may be the same for all of the rings but the change in strip width of the rings may be greater for the inner and outer rings than for the one or more middle rings. The determination of the widths and heights of the various rings can be calculated or arrived at graphically or empirically to achieve the best fill factor. Based on the number of rings to be included in the structure, either the strip width or the build (defined by the number of layers wound to form a ring) or both the strip width and the build may be chosen for each ring to optimize the fill factor (i.e., the amount of magnetic material in the circumscribed circle around the cross-section of the ring-like structure). It will be appreciated that if the ring-like structure is to be built from a pre-defined set of strip widths, the circumscribed circle will define the build or number of layers for each ring.

Once formed the core is preferably thermally conditioned (annealed and domain set). This may involve heating the core to approximately 300° C. The core may be heated for a period of one to two hours, and in order to assist in domain setting the material a magnetic field may be established in the core, e.g., with a strength of approximately 20 Oerstedt, by passing DC current through a winding provided around the core leg or core yoke of the ring-like core structure, or by exerting a physical stress on the core material.

In the case of a DC current-carrying winding, a DC magnetic field is established in the core, which is maintained for one or two hours with the core at its elevated temperature of approximately 300° C.

The surfaces of the wound core are preferably coated with an epoxy, such as Huntsman 5865 A & B, which is a two-part epoxy that cures at room temperature in other words an epoxy that is mixed with a curing agent, to define a shell that provides structural integrity to the wound layers of the core. Different epoxies making use of different curing methods may be used to define the shell, for example, epoxy making use of a curing agent, ultra-violet light curable epoxy, etc. Layers of fiberglass material or fiberglass chop may be included in the shell.

Further, according to the invention there is provided a method of making a transformer from a single phase core as defined above, comprising winding transformer coils onto the core legs without cutting the core or otherwise opening up (unlacing) the ring-like structure. The winding typically includes using a machine designed to wind on the leg. In order to provide a single-phase transformer at least one low voltage winding and at least one high voltage winding is wound onto the core. The low voltage winding may be wound onto one or both of two legs of the core by means of one or more winding tubes or using a bobbin using at least some of the steps set out below.

The low voltage winding may include aramid insulation e.g., DuPont Nomex™ or an equivalent insulation. It may comprise a round or rectangular cross-sectional wire or one or more sections of foil that are wound onto the core leg by means of the winding tube. An insulating layer is then typically provided over the low voltage winding before winding the high voltage winding on top of the insulating layer. Cooling ducts may be included in either the low-voltage winding, the high-voltage winding, or both of the windings utilizing duct sticks or spacers. The number and size of the cooling ducts can be readily determined by calculation by anyone familiar with the art.

Still further, according to the invention, there is provided a method of making a wound single phase amorphous core with substantially round cross-sectional legs, comprising forming a ring-like structure by winding a first or inner set of multiple layers of amorphous metal of a pre-defined strip width, to define an inner ring of a pre-defined width and build, winding at least one middle set of multiple layers of amorphous metal on top of the first or inner ring to define at least one middle ring, the at least one middle ring being wider than the inner ring, and winding an outer set of multiple layers of amorphous metal on top of the at least one middle ring to define an outer ring, the outer ring being narrower than the middle ring. The width of the outer and inner rings may be the same. Multiple middle rings may be included in the core, the widths of the middle rings getting gradually wider until a maximum central ring width is reached, whereafter rings are wound that gradually get narrower again to define a cross-section that fits within a circumscribed circle.

The ring-like structure may be formed to have a race-track configuration by winding the ferromagnetic core material onto a former that provides ring-like structure having a race-track shape. The former may include two spaced-apart semi-circular or other curved sections. Instead the rings may be wound onto a circular former to define a circular ring-like structure, which is thereafter deformed into a race-track configuration or rectangular configuration with rounded corners.

The rings may be made of different grades of amorphous metal or other thin-strip metal. Within a ring some of the layers may be made of different grades of amorphous metal. For purposes of this application, a thin-strip metal core includes a core that is predominantly made of thin-strip metal, notwithstanding that one or more layers of strengthening material of a material other than thin-strip metal, e.g., silicon steel, may be included between rings or on the inside of the core or on the outside of the core. The structural integrity of the thin-strip metal ring-like structure may be enhanced by providing a shell around the core, e.g., by applying an epoxy to the outer surfaces of the core. For ease of reference, in this application, applying an epoxy to the outer surface of the core or any other form of shell around the core will also be referred to as freezing the core. The shell may include at least one of fiberglass material and noise-dampening material. The noise-dampening material may comprise beads, also referred to as phenolic balloons mixed into the resin that is applied to the core surfaces.

The resultant core can then be used as part of a single phase transformer or can be combined with two similar cores to define a three-phase transformer. Instead of using discrete strip widths, the method may instead comprise winding a single strip of magnetic steel that has been cut to define a strip with a double taper. Thus the ends of the strip may be tapered to be narrower than the middle of the strip. Thus the strip defines two longitudinally extending edges or sides, which for at least part of their length (in this case, the end portions), are non-parallel. The strip may be cut using a laser, e.g., a continuous laser operating at a wavelength of 20 nm. The non-parallel portions may be non-linear.

Still further, according to the invention there is provided a transformer core wound from one or more tapered strips of magnetic steel material. This may include a single strip of double tapered magnetic steel material. For purposes of this application, the term double taper refers to the fact that both of the ends of the strip of magnetic steel material are tapered. Also, for purposes of this application, the term "single strip" of magnetic steel material includes not only one but also two or more strips wound simultaneously one on top of the other as part of the formation of a single common ring. Thus, the double taper strip may define a first end and a second end, which are both narrower than the middle of the strip. While both ends define a left and a right side to the strip, typically the taper is applied equally to the left and right side at the first end of the strip and equally to the left and right side at the second end of the strip. The tapers may extend only along part of the length of the strip. Thus part of the strip (the central portion) may include parallel sides with only end portions of the strip being tapered. The tapers at the first or leading end and second or trailing end of the strip may be chosen so that winding the strip into a ring, e.g., a substantially rectangular ring with two substantially straight parallel leg sections and two connecting yokes provides a core cross-section for the first (or inner) half of the ring that is identical to the second (or outer) half of the ring. This requires the tapered section to be longer and more gradual at the trailing end than at the leading end to take account of the increasing path length as the core is wound onto the former or mandrel. Instead the tapers may be chosen so that the core defines an egg-shaped cross-sectional leg with a narrower part toward the outside and a wider part toward the inside since the majority of the magnetic flux will travel the shortest path i.e., along the inside of the racetrack. It will be appreciated that insofar as only the ends of the strip are tapered while the central portion retains parallel sides, the resultant core ring will have a cross-section that is substantially rectangular with truncated corners, or may define a hexagonal or octagonal cross-section depending on the amount of taper and depending on whether the central portion of the strip includes a parallel-sided section. It will also be appreciated that instead of using one continuous strip tapering outward and then inward, a first outwardly tapering strip may be wound to define an inner ring, optionally followed by a parallel sided strip to define a middle ring, followed by an inwardly tapering strip to define an outer ring.

The tapers along the left and right sides of the one or more strips strip may also be formed in a non-linear fashion to define curved left and right sides. It will be appreciated that the curvature of the left and right sides of the strip can be chosen so that when the one or more strips are wound the resultant core cross-section through a leg of the core will be circular thereby minimizing the air gap between the core leg and a surrounding tube-wound coil.

DETAILED DESCRIPTION OF THE INVENTION

The present invention provides a wound transformer core that is produced as a new ring-like wound core configuration that allows coils subsequently to be wound on the legs of the core without cutting the wound layers of the core.

Figure 1:
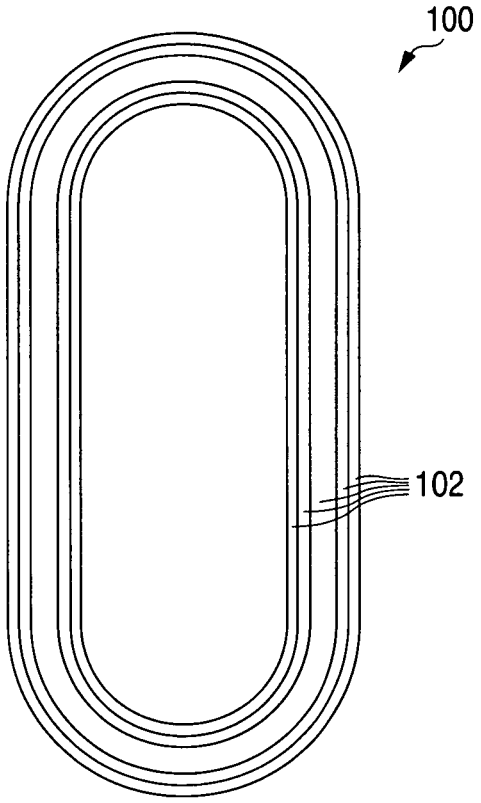
FIG. 1 shows a front view of one embodiment of a wound transformer core of the invention.

FIG. 1 shows a top view of one embodiment of a wound transformer core 100 of the invention. The ring-like structure of the core 100 is made up of multiple rings 102 of magnetic steel, e.g., amorphous metal strip or nano-grain steel material or silicon steel, of different widths (not shown in FIG. 1) wound on top of one another. Insofar as the thickness of the magnetic steel is less than 2.5 mil, e.g., amorphous metal or nano-grain steel, the strip material will be referred to herein in as thin-strip metal.

Figure 2:
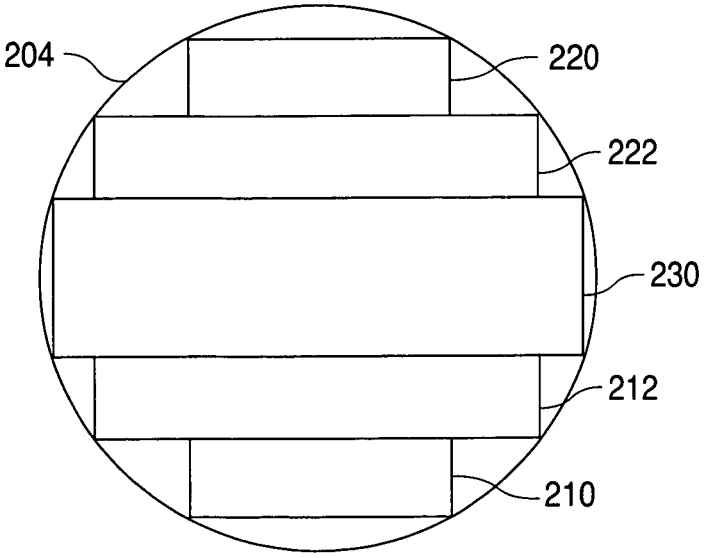
FIG. 2 shows a cross-sectional view through a leg of the core of FIG. 1.
Figure 3:
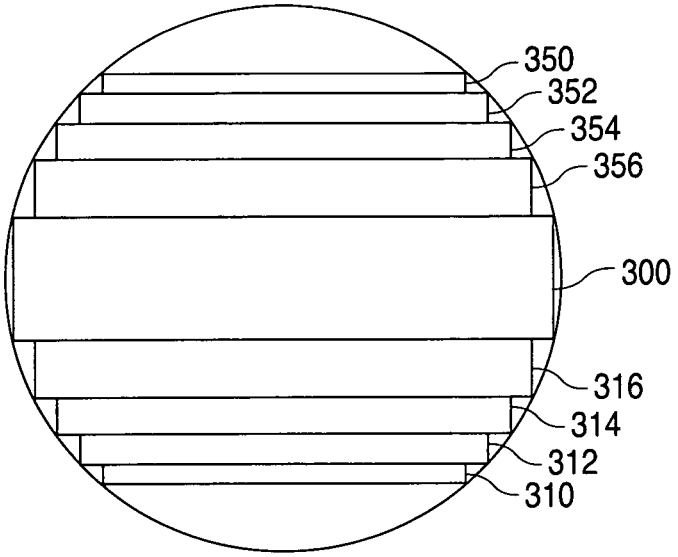
FIG. 3 shows a cross-sectional view through a leg of another embodiment of a wound core of the disclosure.

The different widths of the rings 102 are best illustrated in the cross-sectional views of FIGS. 2 and 3. The ring-like structure defining the core 200 is made up of multiple rings, each of which is wound from one or more strips of magnetic steel. The different width rings define a cross-sectionally stepped structure within circumscribed circle 204 as shown in FIG. 2. The first or inner ring 210 and last or outer ring 220 in this embodiment are made from one or more strips of a first width, which is narrower than the strips of the other rings. The second and second last rings 212, 222 are made from strips of a second width that is wider than the first width. In this embodiment, a middle ring 230 is included between the second ring 212 and second last ring 222, the middle ring 230 being formed from strips of a third width that is wider than the second width, and has twice as many layers as either of the first or second rings. The widths of the rings are arranged to define a completed ring-like structure with a cross-section that has a stepped configuration but is substantially circular as depicted by the circle 204. It will be appreciated that while the above embodiment made use of 5 rings, more or fewer rings could be used and the number of layers per ring may vary in order to achieve a substantially circular cross-section. Thus, for example, the embodiment shown in FIG. 2 makes use of rings that have related step heights. In particular, in this embodiment, the number of layers which defines the thickness of the ring (build of the ring) is the same for each ring except the middle ring, which has twice the build. Thus the change in strip width of the rings gets more pronounced toward the inside and outside of the ring-like structure.

In the embodiment of FIG. 3, the number of rings has been increased and the change in width from one ring to the next has been kept constant. In order to achieve a substantially circular cross-section for the ring-like structure the step height is reduced from one ring to the next as one moves from the middle ring 300 to the outer and inner rings. In other words the build for the first and last rings 310, 350 is less than that for the second and second-to-last rings 312, 352, which in turn is less than the build for the third ring 314 and third-to-last ring 354, which is less than that of the fourth ring 316 and fourth-to-last ring 356.

It will therefore be appreciated that depending on the approach taken in winding a substantially round cross-sectional core, the number of layers per ring may vary from one ring to the next or remain constant. Similarly the change in ring width (as defined by the strip width) from one ring to the next may be a constant change or may become more pronounced toward the inner and outer rings.

It will also be appreciated that practical considerations may require a less than optimum fill factor. The number of strip widths that are included determines how fully the circumscribed circle can be filled. Therefore by necessity, reducing the number of strip widths reduces the fill factor that can be achieved. Also, for a defined number of strip widths an optimum fill factor may be achieved if both the strip widths and the build may be selected. On the other hand, this optimum fill factor may not necessarily be achieved if the design of the core is limited to pre-defined strip widths based on strip widths available to the manufacturer in its inventory.

The rings in the above embodiments were wound in a race-track configuration by winding onto an oblong former to define a core with two substantially straight, parallel legs joined at their ends by curved yokes. In another embodiment the rings were wound in a circular configuration and subsequently deformed to define two substantially parallel legs. Tests have, however, shown that greater winding speed is achieved and less stress is introduced into the core if the rings are initially wound in circular fashion to define a circular ring-like structure that is subsequently deformed to define two substantially straight, parallel legs joined at their ends by curved (e.g., semi-circular) yokes.

Figure 4:
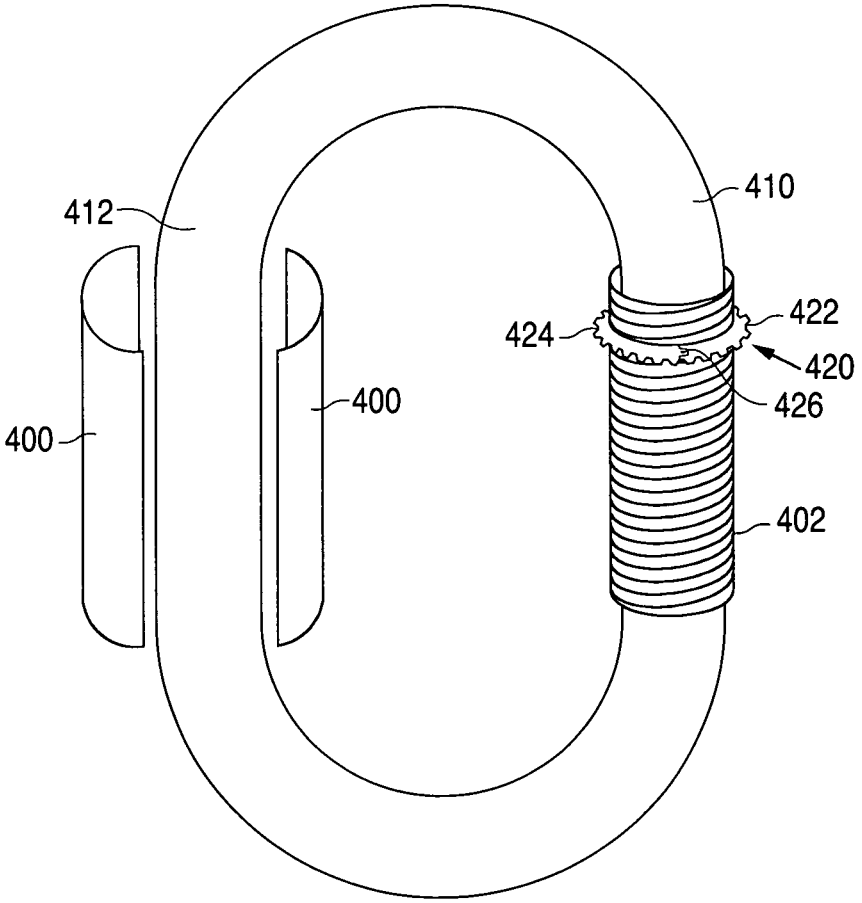
FIG. 4 shows a front view of one embodiment of a single phase transformer core of the invention showing the use of winding tubes to wind coils on the legs of the core.

By forming a core with two substantially straight, parallel legs, split winding tubes can be placed around the legs and attached together for winding the primary and secondary transformer coils onto the legs without the need to cut the core in order to place or land the coils on the legs. This is shown in FIG. 4 in which two winding tube halves 400 are placed around each substantially straight core leg 410, 412 and connected together, e.g., by means of tape to define a winding tube 402 as shown around the leg 410. In this embodiment the two tube halves are secured to each other by means of a thermally graded tape wrapped around the tube 402. One or more gears or sprockets 420 that are split into two halves 422, 424 are secured to the winding tubes for purposes of rotating the tubes by means of a motor that engages the sprocket or gear with a chain or complementary gear. In this embodiment the sprocket or gear halves 422, 424 are provided with tabs 426 having threaded holes in them for receiving bolts to connect the sprocket or gear halves to each other. In order to transfer the energy from the sprocket or gear 420 to the tube 402 the gears engage the tube in a non-slip relationship, e.g., by providing the sprocket or gear with radially inwardly extending tabs for engaging complementary notches or holes in the tube.

By avoiding the need to cut the core material into sections in order to unlace the core and land the coils on the core, a substantial benefit is achieved over prior art wound distributed gap cores or stacked butt-lap and step-lap cores, which comprise cut sections of core material that overlap each other to define a complete flux path. The overlapping arrangement of sections is adopted in distributed gap, butt lap and step-lap cores to allow the core to be opened up or unlaced in order to land the coils on the core. Thereafter the core layers have to be put together again or re-laced. The problem with this prior art approach is that the core material provides the path (roadway) along which the flux travels. At every cut and gap the flux must make a detour. In butt lap cores the problem is particularly acute since the gap may be large, which makes it much more difficult for the flux to find an alternative path, thus leading to fringing, etc. Techniques such as step-lap cutting shorten the detour since the detour may be only one laminate thickness away, however, the flux still has to make a detour, which leads to losses. Every cut and gap increases the reluctance of the core and adds to losses and sound. Prior art wound core configurations such as distributed gap cores retain this problem by winding the magnetic material, e.g., amorphous metal in sections onto a former, thereby allowing the core subsequently to be opened up or unlaced in order to receive the core. In the case of annealed amorphous metal this process is particularly problematic due to the brittleness of the material after annealing or domain setting. The unlacing and re-lacing invariably results in a substantial amount of flaking of the amorphous metal, which increases the risk of pieces of amorphous metal later causing electrical shorting problems.

Thus by adopting a cross-sectional core shape that allows a winding tube to rotate on the leg of the core while avoiding large air gaps between the core and the coils, the present invention allows the coils to be wound on the leg. This avoids having to create gaps in the magnetic field path and avoids unlacing and re-lacing of core layers in order to land the coils on the core legs.

Figure 5:
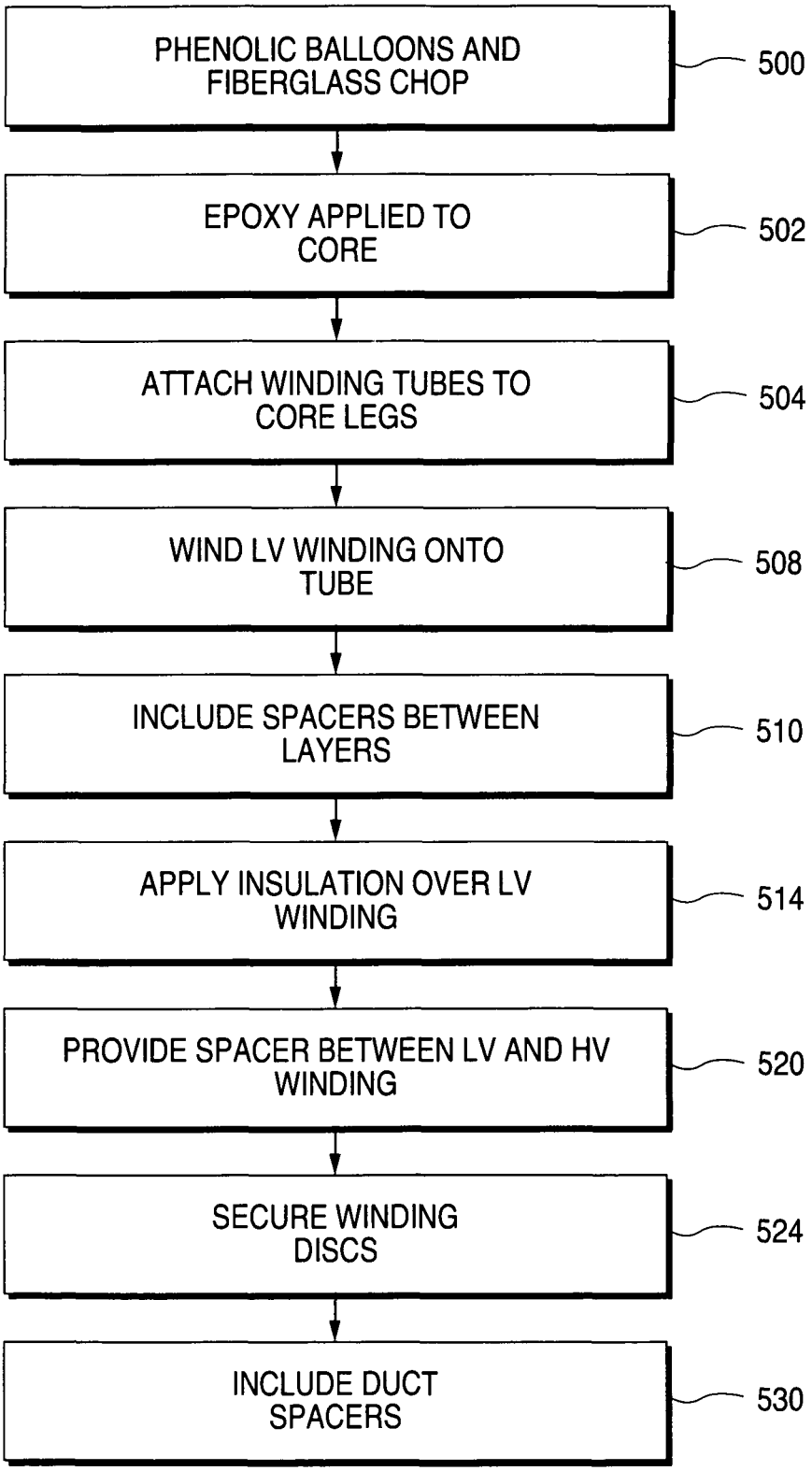
FIG. 5 is a flow chart describing the winding process of the disclosure.

As depicted by the flow diagram of FIG. 5, in one embodiment, before applying the first layer of the coil windings, the surfaces of the core are coated with an epoxy (step 502), which in this embodiment is a two-part epoxy (Huntsman 5865 A & B) that cures at room temperature. This has the benefit of strengthening the core. The epoxy also provides a smoother outer surface to the core, thereby making it easier for the winding tube to rotate on the core leg. In this embodiment the resin or epoxy coating is further strengthened by adding fiberglass chop into the resin or epoxy. Phenolic balloons are added to the resin to provide sound dampening as depicted by step 500. Once the epoxy has cured, the winding tube is rotatably attached to the core (step 504). In one embodiment, a low voltage winding is then wound (step 508), onto each of the legs. The windings may include a polymeric or other insulation e.g., DuPont Nomex™. One or more layers of insulating material are then applied over the low voltage winding (step 514), before winding the high voltage winding on top of the low voltage winding. As is known in the art, a low and high voltage winding can be applied to each leg or the high voltage winding can be wound on one leg and the low voltage winding on the other leg. Typically, spacers or ducts are included as part of the coil design process and are included into the windings for cooling purposes. Thus spacers of the pre-designated thickness are axially arranged around the circumference of the winding between some or all of the winding layers (step 510). Spacers are provided in this embodiment between the low voltage and the high voltage windings (step 520).

If the high voltage winding is to be disc wound the process begins by winding discs with insulated rectangular wire (step 524). As insulator for the wire, DuPont Nomex™ is used in one embodiment. In another embodiment a wire insulated with a polymer film that is compatible with the resins used between the layers of windings is used. Axially arranged duct spacers are again provided between the layers of the windings depending on the design requirements of the transformer (step 530).

When the high voltage winding is complete a thin coating of compatible polymer or a varnish is applied to the windings by spraying the polymer onto the windings using nozzles or by dipping the entire transformer in a polymer or varnish.

In the above embodiment, the coils were implemented using aluminum or copper wire having a round cross section or a rectangular cross section and covered with Nomex. The invention could instead be implemented using foil material and insulators. For instance foil conductors in the form of sheets could be wound onto the core legs using a winding tube. In one embodiment the foil is wound in two side-by-side sections that are then connected beginning to end so that the direction of the winding is the same for both sections (either both clockwise or both anti-clockwise). The invention is not limited to only one or two sections of foil. More than two sections can for instance be implemented. This also has the advantage that each section is narrower allowing resin to penetrate more easily between the coils.

The core and resultant transformer, whether used as a single phase transformer or used as a set of three single phase cores wired to define a three phase transformer, produces numerous advantages. The process produces an amorphous core with minimum stress in the core, which does not require multiple cuts or post annealing manipulation in order to land the coils. The simple ring-like configuration of each single phase core does not require physical interconnection of core material with other single phase cores and does not require cutting or splicing together of layers of core material, thereby allowing each core structure to be wound separately and very quickly. Thus a core can be produced in much less time than any type of distributed-gap wound core. The configuration and process entirely eliminates damage to the core material due to cuts and gaps. Flaking and chips are virtually eliminated since there is no need to unlace the layers of core material in order to land the coils on the core, or to re-lace the core material. Testing has shown core losses using amorphous metal to be 6-10% lower than comparable Evans or five-legged amorphous cores. The cores produced may be operated at induction levels higher than amorphous Distributed Gap cores. By providing a core configuration in which the cross-sectional area of the yokes and legs are the same, the core can be operated at higher induction levels than three-phase configurations having different cross-sectional areas in parts of the core, such as Stadium cores provided by Haihong in China, and Hexaformer cores, both of which result in reduced core material in the yokes compared to the legs of the core. Audible sound levels have also been found to be lower at the higher induction levels than is the case with amorphous distributed gap cores.

The single-phase transformers produced by this method are suitable for applications in which any other single-phase transformers are utilized, either as stand-alone single-phase transformers or wired together with other single-phase transformers to provide three-phase transformers. Cores using this invention may readily be produced ranging from 15 kVA through 3.3 MVA.

The present application also includes the forming of a wound transformer core from one or more strips of magnetic steel material, wherein at least some of the strips have tapered sides. For instance, a single strip can be used having a first and a second end with a double-sided taper toward each end, which may or may not have a central un-tapered portion, as discussed in greater detail below.

As discussed further below, and as described in co-filed application to the same applicant, entitled "Laser Slitting of Magnetic Steel" the taper may be cut with a laser.

Figure 6:
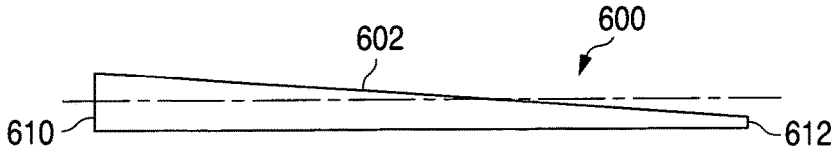
FIG. 6 shows one embodiment of a single tapered strip of the disclosure (Haihong type taper)

As is discussed in co-filed application entitled "Laser Slitting of Magnetic Steel", the use of a laser to slit or cut magnetic steel can be applied to the manufacture of existing tapered ribbons such as the Haihong (or Stadium) configuration core, which to the best of the applicant's understanding makes use of a single tapered ribbon in forming its three-phase wound core. The Haihong strip of magnetic core material 600 appears to be limited to a single taper along one side 602 that extends the full length of the strip of magnetic core material from a first end 610 to a second end 612 as illustrated in FIG. 6. It will be appreciated that the depictions of the strip shapes given above and the other embodiments discussed below are not to scale. Actual strips will be significantly longer and the taper cut more gradually, and in many instances slightly curved.

Figure 7:
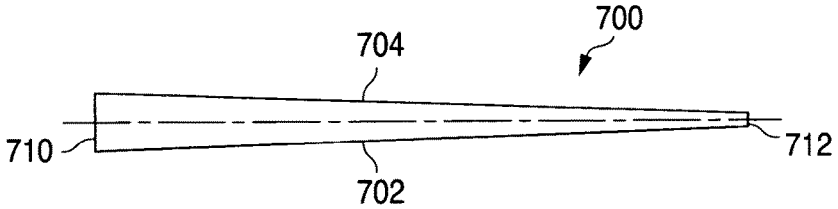
FIG. 7 shows another embodiment of a single tapered strip of the disclosure (tapered both left and right sides of the strip but at only one end)

FIG. 7 shows another embodiment of a single tapered strip 700 of the invention. In this embodiment the taper is applied to both the left side 702 and the right sides 704 of the strip and again extends along the entire length of the strip from the first end 710 to the second end 712. It will be appreciated that when this strip is wound starting with the narrow end, the wound ring will gradually get wider. In order to provide a substantially circular cross-section to the core, a second ring has to be wound on top of the first ring that tapers the opposite way, i.e. starts wide and ends narrow to define, for example a hexagonal cross-section. In another embodiment, a central ring wound from parallel-sided strip material can be formed between the inner and outer rings to defined, for example, a core with an octagonal cross-section.

Figure 8:
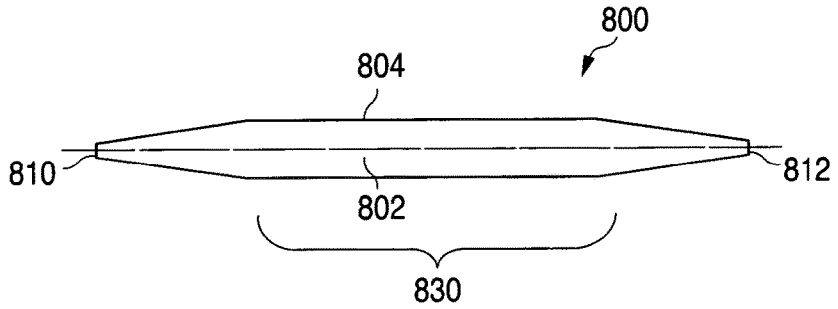
FIG. 8 shows one embodiment of a double tapered strip of the disclosure (both first and second ends tapered the same way)

FIG. 8 shows one embodiment of a double tapered strip 800 of the present disclosure in which both the first end 810 and the second end 812 are narrowed relative to a central portion 830 of the strip. In other words the strip 800 defines two opposite tapers. In this embodiment both the one side 802, e.g., the left side, and the other side 804, e.g., the right side of the strip are equally tapered and the tapers at the two ends do not extend all the way to the middle. In other words the strip 800 defines a central portion 830 with parallel sides.

Figure 9:
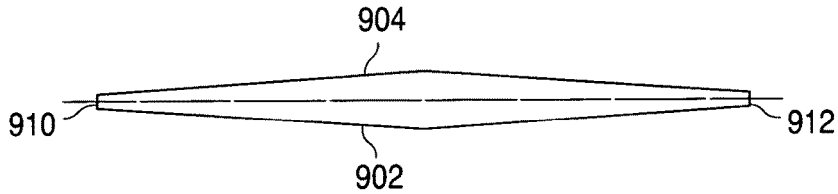
FIG. 9 shows another embodiment of a double tapered strip of the disclosure (both first and second ends tapered the same way with tapers extending to the middle of the strip)

FIG. 9 shows another embodiment of a double tapered strip 900 of the invention that is similar to that of FIG. 8. However in this embodiment the taper at the first end 910 and the taper at the second end 912 extend to the middle of the strip. As in the strip of FIG. 8, the strip 900 is tapered identically along both the left and right sides, 902, 904.

Figure 10:
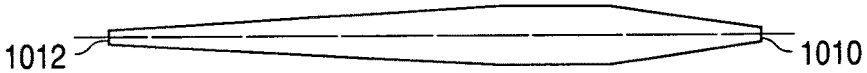
FIG. 10 shows another embodiment of a double tapered strip of the disclosure (taper at first end being different to taper at the second end)

FIG. 10 shows yet another embodiment of a double tapered strip 1000 of the present disclosure, in which the taper at the first end 1010 is different to the taper at the second end 1012.

In the above embodiments the tapers were depicted as straight-sided or linear tapers, for purposes of simplicity. In practice, however the taper will be curved in order to take account of the increasing path length as the ring's diameter increases. This will be discussed in greater detail below with reference to FIGS. 18-21.

Figure 11:
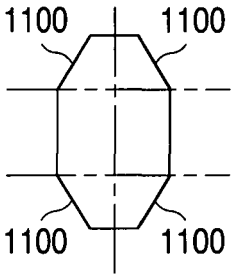
FIG. 11 shows a cross-sectional view through a leg of a wound core of the disclosure made using a strip such as that illustrated in FIG. 8.
Figure 12:
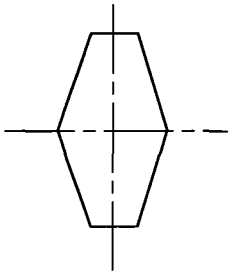
FIG. 12 shows a cross-sectional view through a leg of a wound core of the disclosure made using a strip such as that illustrated in FIG. 9.
Figure 13:
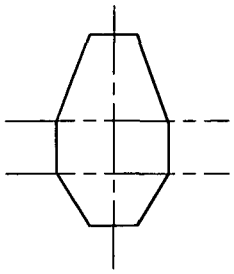
FIG. 13 shows cross-sectional view through a leg of a wound core of the disclosure made using a strip such as that illustrated in FIG. 10.

The effect of these different double tapered strips (when path length is taken into account and the taper, correctly curved) is shown in FIGS. 11 to 13. It will be appreciated that the impact of the taper will become more pronounced as the ring diameter increases, thus requiring a concave or convex taper, as will be discussed in further detail below with respect to FIGS. 18 and 19.

FIG. 11 shows a simplified cross-sectional view through a leg of a wound core of the invention made using a strip similar to that illustrated in FIG. 8 (but with the appropriate curvature to the taper). Since the central portion 830 of strip 800 is not tapered the resultant ring has a cross section that is substantially rectangular with truncated corners 1100. By correctly choosing the curvature of the taper and length of each portion of the strip, an octagonal cross-section can be achieved.

FIG. 12 shows a cross-sectional view through a leg of a wound core of the invention made using a strip similar to that illustrated in FIG. 9 (but with the appropriate curvature to the taper). In the strip 900 the tapers at the two ends 910, 912 extended to the middle of the strip thereby defining a wound ring with a 6-sided cross-section, which may be arranged to be hexagonal if the curvature of the taper is calculated correctly.

FIG. 13 shows a cross-sectional view through a leg of a wound core of the invention made using a strip similar to that illustrated in FIG. 10 (but with the appropriate curvature to the taper). In this embodiment the taper at the first end 1010 was different to that at the second end 1012, not only to take account of the greater path length toward the outer portion of the ring, but also to achieve a different cross-sectional profile to the core ring, resulting in a wound ring with a non-uniform or substantially egg-shaped cross-section.

Figure 14:
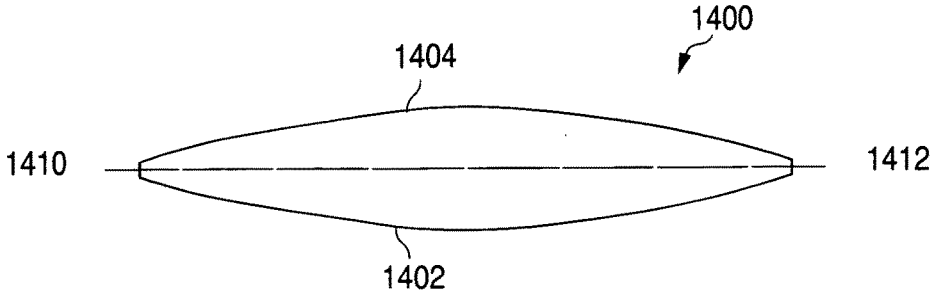
FIG. 14 shows a yet another embodiment of a double tapered strip of the disclosure.
Figure 15:
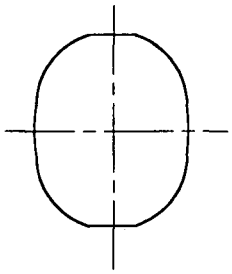
FIG. 15 shows a cross-sectional view through a leg of a wound core of the disclosure made using a strip such as that illustrated in FIG. 14, FIG. 16, shows one embodiment of a core winder of the invention in which a laser cutter is mounted on the winder.

In the embodiments discussed above the tapers were depicted as linear tapers for purposes of simplicity, but for the purpose of achieving multi-sided cross-sections. The present disclosure also allows for non-linear tapers such as the strip 1400 shown in FIG. 14, which provides a curved taper at both the left and right sides 1402, 1404 of the first end 1410 and the second end 1412 that is sufficient to achieve a cross-section with curved outer surface. The result is that when the strip 1400 is wound into a core ring the cross-section of the ring of this embodiment is substantially circular as shown in FIG. 15, which shows a cross section of the resultant core ring formed from winding the strip of FIG. 14.

Figure 16:
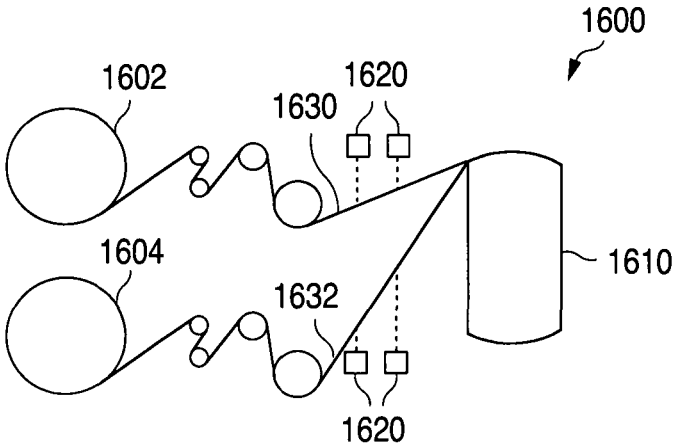

FIG. 16, shows one embodiment of a core winder 1600 of the invention in which one or more laser cutters, e.g., a continuous 20 nm wavelength laser, is mounted on the winder. In this embodiment two pay-out reels 1602, 1604 are used to wind two ribbons or strips 1630, 1632 onto a single former or winding head 1610, which in this embodiment is depicted as a race-track former 1610. It will be appreciated that the two ribbons or strips 1630, 1632 are wound simultaneously one on top of the other onto the same former 1610 to produce a single common race-track-shaped ring. Instead only one of the pay-out reels 1602 or 1603 could be loaded onto the winder to wind only one strip onto the former 1610. Since a single ring is formed in both cases, the use of two strips wound simultaneously on top of one another onto a common former, also referred to herein as a 2-ply or multi-ply arrangement, will be considered herein as forming a ring from a single or continuous strip or ribbon since multiple wound strips are wound simultaneously as one. The laser cutter in this 2-ply embodiment is implemented as 4 laser units 1620 for cutting both the left and right sides of each strip 1630, 1632 as the two strips are wound from the two pay-out reels onto the former 1610. In this embodiment the cut-off portions along the left and right sides of the strips 1630, 1632 are discarded or collected as scrap.

In another embodiment, where a substantial amount of material would be discarded, the cut off portion can be wound onto one or two separate take-up reels. For instance, in one embodiment a strip 1700 such as that shown in FIG. 17 could be slit diagonally as shown, to end up with two tapered sections 1702, 1704. It will be appreciated that although each section is tapered along one side only, the two sections 1702, 1704 can be considered as double sided tapered strips by defining the central axes as 1712, 1714, respectively. The one strip 1702 can be wound onto a first take-up reel to form the inner ring of a core since it gradually increases in width. The second strip 1704 will be starting with the wide end and therefore define a gradually narrowing ring. This can subsequently be re-wound onto a new or third take-up reel to define a ring that is gradually increasing and thus usable as an inner ring for another core.

Figure 17:
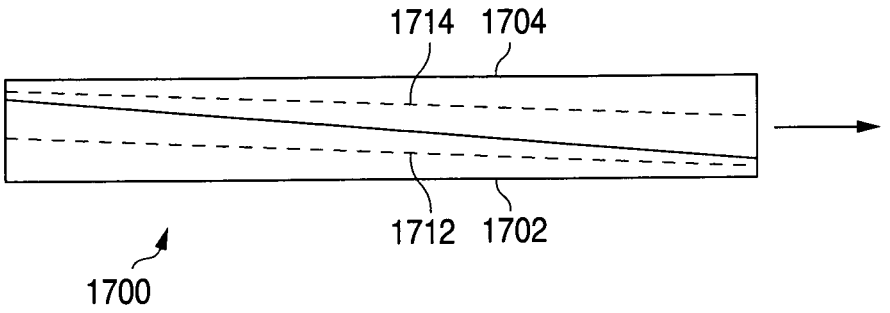
FIG. 17 shows a strip slit to define two strips with tapered sides.
Figure 18:
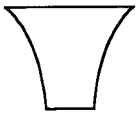
FIG. 18 shows an exaggerated cross section through a ring formed from a straight sided strip with double taper starting with the narrow end of the strip.
Figure 19:
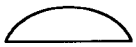
FIG. 19 shows an exaggerated cross section through a ring formed from a straight sided strip with double taper, starting with the wide end of the strip.

As mentioned above with respect to FIGS. 11-13, the cross-sections shown in FIGS. 11-13 are simplified depictions and do not accurately reflect the cross-section when taking into account the changing diameter of the ring as it is wound. Considering again the embodiment of FIG. 17, if strip 1702 were wound to define the inner ring of a core, then taking into account the ever increasing path length of each successive layer due to the increasing build on the take-up reel, the cross-section of the first ring would have concave sides and look substantially as depicted in FIG. 18. Similarly, if the strip 1704 were wound onto a second take-up reel, it would have a cross-section with convex sides, substantially as shown in FIG. 19. A further complication that arises is if this strip 1704 were then re-wound onto a third take-up reel and thereafter wound on top of the inner ring formed by strip 1702. The increased path length of this outer ring (since it is formed onto the inner ring, which itself has a certain build) coupled with the ever increasing path length with each layer built on top of the previous layer will result not only in convex side walls to the outer ring but also in fewer layers and a smaller build for the outer ring. In practice, therefore the taper of the strips would have to be adjusted for the inner and outer rings and the outer ring would have to be made from a longer strip than the inner ring if, for instance a hexagonal or octagonal cross-section is to be achieved.

Figure 20:
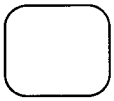
FIG. 20 shows a cross-section through another embodiment of a core leg of the present disclosure.
Figure 21:
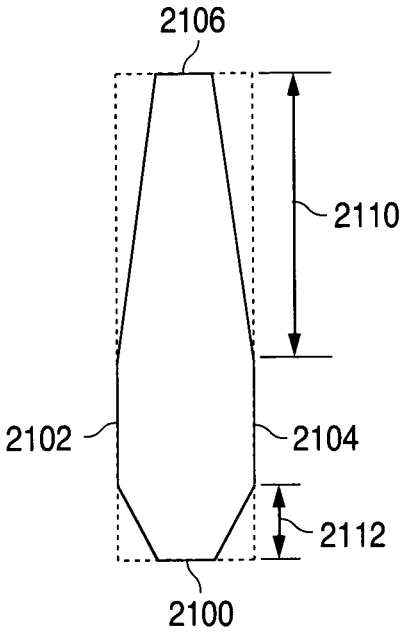
FIG. 21 shows a strip (not to scale) for forming a core as shown in FIG. 20.
Figure 22:
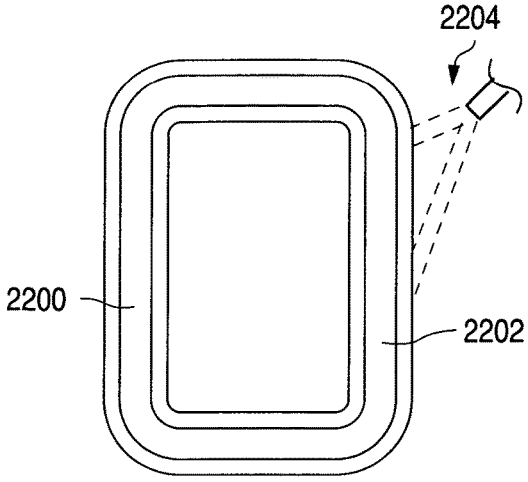
FIG. 22 shows a front view of one embodiment of a single phase core of the application.

One embodiment of the present disclosure involves forming a substantially square cross-sectional core with rounded corners, as shown in FIG. 20, which can be achieved by trimming both sides 2102, 2104 towards each end 2100, 2106 of the strip at a taper to form a leading tapered portion 2112 at a first or starting end 2100 of the strip as shown in exaggerated fashion in FIG. 21. The leading end 2100 has the sides 2102, 2104 slit at a curve for the portion 2112, to define convex surfaces (For ease of depiction, the curved sides of portion 2112 are simply shown as straight lines in FIG. 21. In practice, the curved sides will depend on the desired cross sectional shape and the cross sectional area of the core, since for larger cores the curved corners of the cross section will have a larger radius and will be longer, thus affecting a longer portion 2112 of the strip). For the trailing end 2106, the tapered portion 2110 is tapered over a longer distance than the tapered portion 2112, since the path length of each turn will be getting longer toward the trailing end 2106 due to the ever increasing build of the core (Again, for ease of reference the tapered sides of portion 2110 are simply shown as straight tapers but in practice may be curved to define convex sides to provide a core cross section that is substantially square 2308, 2350, 2352 with rounded corners as depicted in FIG. 20).

In one embodiment of the present application, a single phase transformer core is formed using an amorphous metal or other thin-strip metal that has tapered ends as discussed with respect to FIG. 21 to provide a core as depicted in FIG.

22, with a leg cross section through legs 2200, 2202 similar to that shown in FIG. 20. Unlike the embodiments of FIGS. 2 and 3, the entire single phase core in this embodiment can be wound from a single strip of thin-strip metal Since the present invention deals with thin-strip material, which has little structural integrity on its own, an exo-skeleton has to be formed that will support the core. In one embodiment, an epoxy is applied to the core windings, e.g., by spraying, as depicted by reference numeral 2204. The epoxy can be a UV-cured (ultra-violet cured) resin and can be applied during the winding process, continuously or at various stages of the winding. Instead the epoxy can be applied once the core winding is complete. The epoxy coating over the core covers and strengthens the core as a precursor to winding any coils onto the core to form a transformer. In the present invention, coils are wound onto the core legs using winding tubes that are rotatably affixed to the core legs and then rotated in order to wind the coils onto the core tubes, as discussed above with respect to FIG. 4.

In contrast, in the case of prior art cores such as wound digital gap cores, coils are wound separately and then placed onto the core legs by opening up the core (unlacing the core). In other words the core is made up of strip sections, each forming one turn of the wound core, rather than a continuously wound strip of multiple turns. This lacing and unlacing process damages the core and adds unlacing and re-lacing steps. Also, since part of the core cannot be protected by an epoxy or other protective layer until the coils have been placed on the legs, a second epoxy application step has to be introduced once the core layers are re-laced, in order to cover the rest of the core with epoxy.

In the present invention, the core is wound from one or more continuous strips of thin-strip metal, each strip being wound up to form a ring having multiple turns, for example, several hundred turns of amorphous metal or nano-grain steel. In the case of a cruciform configuration, such as the one shown in FIG. 2, the core is made up of multiple rings of different strip width wound on top of each other to form the staggered cruciform cross-section. The center lines of the strips, depicted for example by line 1420 in the FIG. 14 embodiment, or by lines 1712 and 1714 in the embodiment of FIG. 17, are aligned in a plane one on top of each other as the strip is wound up into a ring. Insofar as the core is made up of multiple rings, the center lines of the strips in the various rings are also aligned with each other.

Figure 23:
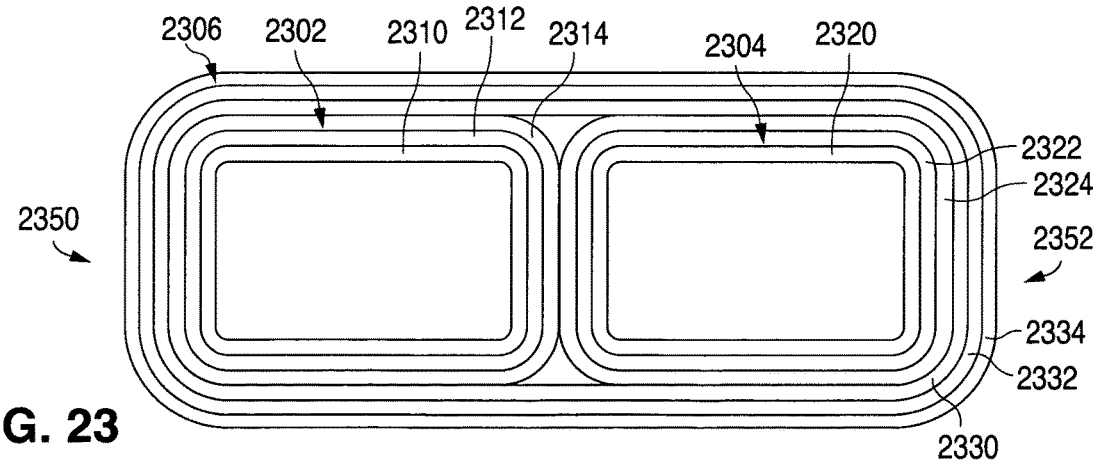
FIGS. 23-24 show front views of two embodiments of a three phase core of the application.
Figure 24:
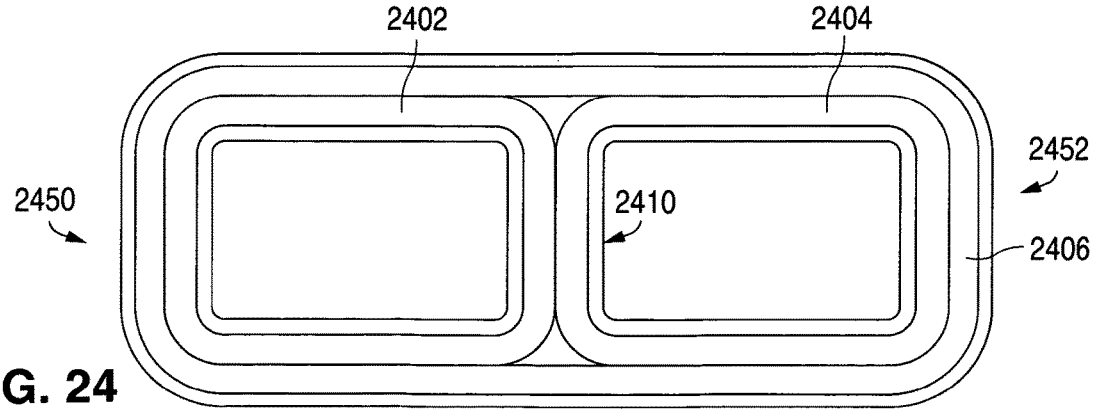

In other embodiments of the present application, a three phase transformer core is formed, either using multiple parallel-sided strip widths as depicted in FIG. 23 or using strip widths with tapered ends as shown in FIG. 24.

In the embodiment of FIG. 23, two inner frames 2302, 2304 are formed. Each frame 2302, 2304 is made up of multiple rings (in this case 3 rings). Frame 2302 is wound from three parallel sided strip widths to form three rings 2310, 2312, 2314 of ever increasing width. Similarly, frame 2304 is wound from three parallel sided strip widths to form three rings 2320, 2322, 2324 over increasing width. The two frames 2302, 2304 are then mounted side by side on a core winding machine to serve as take-up for a third, outer frame 2306. When two such frames 2302, 2304 are placed next to each other they define a central leg 2308 having a cross-section similar to that shown in FIG. 2, which for purposes of this application will be referred to as a substantially round cross-section.

The frame 2306 is also made of three strip widths, which are of the same width as the strip widths used in the rings of frames 2302, 2304. However, in the case of frame 2306 the first ring 2330 to be wound onto frames 2302, 2304 has the widest strip width (same width as that used for rings 2314, 2324). The next two rings wound onto the first ring 2330 become progressively narrower. In other words, ring 2332 has the same strip width as rings 2312, 2322, while ring 2334 has the same width as rings 2310, 2320.

The effect of forming frame 2306 around frames 2302, 2304 is to provide substantially straight parallel legs 2350, 2352 on either side of central leg 2308, each of the legs having a substantially circular cross-section similar to that depicted in FIG. 20. Like leg 2208, the legs 2350, 2352 have a cross section similar to that shown in FIG. 2.

Again the core is frozen using one or more epoxy coatings to cover the core before the coils are wound onto the three legs 2308, 2350, 2352.

Figure 25:
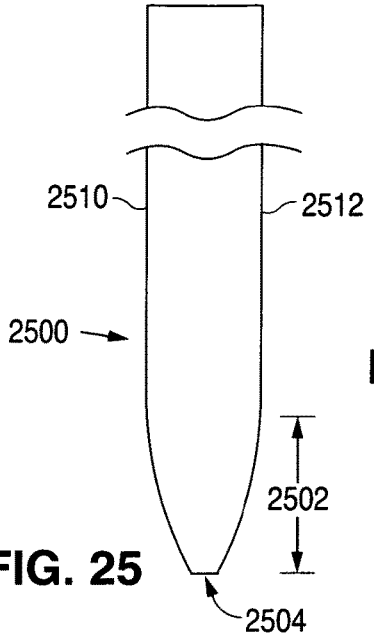
FIG. 25 shows a top view of a strip of thin-strip metal for use in one embodiment of a core of the application.
Figure 26:
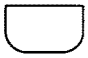
FIG. 26 shows a cross-section through a frame of the core embodiment of FIG. 24.

In the embodiment of FIG. 24, two inner frames 2402, 2404 are each formed from a strip similar to the strip 2500 shown in FIG. 25, having a tapered portion 2502 at the first or starting end 2504. In this embodiment the taper is a non-linear taper, in which the sides of the strip converge in non-parallel, non-linear fashion. (In another embodiment, a strip with a linear taper can be used instead). The rest of the strip has parallel longitudinal sides 2510, 2512. The effect of winding a strip 2500 onto a former having two parallel sides is to form a frame cross-section similar to that depicted in FIG. 26. When two such frames 2402, 2404 are placed next to each other they define a central leg 2410 having a square cross-section with rounded corners, similar to that shown in FIG. 20, which for purposes of this application will be referred to as a substantially round cross-section.

The two frames 2402, 2404 are mounted side by side on a core winding machine to serve as take-up for a third, outer frame 2406. The outer frame 2406 is wound from a thin-strip metal that has a tapered portion at one end similar to strip 2500 shown in FIG. 25. However, in this case the parallel portion is chosen as the starting end, while the tapered portion 2502 is at the terminating end. Also, since the path length of each turn of the third (outer) frame 2406 is much longer than that of the first and second frames 2402, 2404, the strip for frame 2406 will be much longer and the tapered portion will also be longer than the tapered portions of the strips used for frames 2402, 2404. The effect of forming frame 2406 around frames 2402, 2403 is to provide substantially straight parallel legs 2450, 2452 on either side of central leg 2410. Like leg 2410, the legs 2450, 2452 have a cross section similar to that shown in FIG. 20.

Again the core is frozen using one or more epoxy coatings to cover the core before the coils are wound onto the three legs 2410, 2450, 2452.

While the invention has been described with respect to specific embodiments it will be appreciated that the invention is not so limited but includes other implementations as defined by the scope of the claims and as may be readily determined by someone familiar with the art.

What is claimed is:

1. A method of making a thin-strip metal transformer core for a transformer, comprising winding one or more rings, each ring formed by winding multiple turns of continuous thin-strip metal, wherein the thin-strip metal is controlled so that the turns lie one on top of the other with the center line of the strip for each turn aligned in a plane;

configuring the one or more rings to define two or more straight core legs having a substantially circular cross-section, and freezing the core by applying an epoxy or other shell to the outer surfaces of the core before applying any transformer coil windings.

2. The method of claim 1, wherein each ring is wound from parallel sided thin-strip-metal, and rings of different strip widths are wound on top of each other to define the substantially circular cross section for the core legs.

3. The method of claim 2, wherein the core is configured to have two straight core legs, which are connected at each end by a yoke.

4. The method of claim 1, the method further comprising winding a first set of two or more rings of different strip widths on top of each other to define a first frame;

winding a second set of two or more rings of different strip widths on top of each other to define a second frame;

arranging the first and second frames next to each other to define a first core leg of a transformer core between them, and winding a third set of two or more rings of different strip widths on top of first and second frames, to define a second and a third core leg located on either side of the first core leg.

5. The method of claim 1, wherein the freezing comprises applying an epoxy to the core at one or more stages as the rings are being wound, or continuously as the rings are being wound, or once all of the rings have been wound.

6. The method of claim 1, wherein at least some of the rings are wound from strips of thin-strip metal, the sides of which are non-parallel for at least part of the length of the strip.

7. The method of claim 6, wherein the strip for each ring includes a first end defining a starting end and a second end defining a terminating end, and wherein one or more of the rings has a non-parallel sided, tapered portion at the starting end or the terminating end or at both the starting and terminating ends.

8. The method of claim 7, the method further comprising winding a first ring from a thin-strip metal having a non-parallel sided, tapered portion at the starting end, to define a first frame;

winding a second ring from a thin-strip metal having a non-parallel sided, tapered portion at the starting end, to define a second frame;

arranging the first and second frames next to each other to define a first core leg of a transformer core between them, and winding a third ring from a thin-strip metal having a non-parallel sided, tapered portion at the terminating end on top of first and second frames, to define a second and a third core leg located on either side of the first core leg.

9. The method of claim 7, wherein the non-parallel sided, tapered portions are non-linear tapered portions.

10. A method of making a transformer, comprising winding a transformer core, which includes winding one or more rings, each ring formed by winding multiple turns of continuous thin-strip metal, wherein the thin-strip metal is controlled so that the turns of the strip lie one on top of the other with the center line of the strip for each turn aligned in a plane, and configuring the one or more rings to define two or more straight core legs having a substantially circular cross-section, the method further comprising freezing the core by applying an epoxy or other shell to the outer surfaces of the core, and winding transformer coil windings onto at least some of the legs after the freezing step.

11. The method of claim 10, wherein the freezing comprises applying an epoxy to the core at one or more stages as the rings are being wound, or continuously as the rings are being wound, or once all of the rings have been wound.

12. The method of claim 10, wherein each ring is wound from parallel sided thin-strip metal, and rings of different strip widths are wound on top of each other to define the substantially circular cross section for the core legs.

13. The method of claim 12, wherein the core is configured to have two straight core legs, which are connected at each end by a yoke.

14. The method of claim 10, wherein the winding of the core includes, winding a first set of two or more rings of different strip widths on top of each other to define a first frame;

winding a second set of two or more rings of different strip widths on top of each other to define a second frame;

arranging the first and second frames next to each other to define a first core leg of a transformer core between them, and winding a third set of two or more rings of different strip widths on top of first and second frames, to define a second and a third core leg located on either side of the first core leg.

15. The method of claim 10, wherein at least some of the rings are wound from strips of thin-strip metal, the sides of which are non-parallel for at least part of the length of the strip.

16. The method of claim 15, wherein the strip for each ring includes a first end defining a starting end and a second end defining a terminating end, and wherein one or more of the rings has a non-parallel sided, tapered portion at the starting end or the terminating end or at both the starting and terminating ends.

17. The method of claim 16, wherein the winding of the core includes, winding a first ring from a thin-strip metal having a non-parallel sided, tapered portion at the starting end, to define a first frame;

winding a second ring from a thin-strip metal having a non-parallel sided, tapered portion at the starting end, to define a second frame;

arranging the first and second frames next to each other to define a first core leg of a transformer core between them, and winding a third ring from a thin-strip metal having a non-parallel sided, tapered portion at the terminating end, on top of first and second frames, to define a second and a third core leg located on either side of the first core leg.

18. The method of claim 16, wherein the non-parallel sided, tapered portions are non-linear tapered portions.

* * * * *